US009592996B2

(12) United States Patent
Yamagishi

(10) Patent No.: US 9,592,996 B2
(45) Date of Patent: Mar. 14, 2017

(54) ELEVATOR SYSTEM

(71) Applicant: MITSUBISHI ELECTRIC CORPORATION, Chiyoda-ku (JP)

(72) Inventor: Koji Yamagishi, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 14/913,178

(22) PCT Filed: Sep. 3, 2013

(86) PCT No.: PCT/JP2013/005184
§ 371 (c)(1),
(2) Date: Feb. 19, 2016

(87) PCT Pub. No.: WO2015/033370
PCT Pub. Date: Mar. 12, 2015

(65) Prior Publication Data

US 2016/0200548 A1 Jul. 14, 2016

(51) Int. Cl.
*B66B 5/02* (2006.01)
*B66B 9/00* (2006.01)
(Continued)

(52) U.S. Cl.
CPC ..... *B66B 5/02* (2013.01); *B66B 1/06* (2013.01); *B66B 3/02* (2013.01); *B66B 9/00* (2013.01); *B66B 2201/307* (2013.01)

(58) Field of Classification Search
CPC .... B66B 5/02; B66B 3/02; B66B 1/06; B66B 9/02
See application file for complete search history.

(56) References Cited

U.S. PATENT DOCUMENTS 4,971,178 A * 11/1990 Schauder ..... B66B 5/10 187/294
6,202,796 B1 * 3/2001 Lee ..... B66B 1/30 187/284
(Continued)

FOREIGN PATENT DOCUMENTS

JP 61-111284 A 5/1986
JP 10-302558 A 11/1998
(Continued)

OTHER PUBLICATIONS

International Search Report Issued Dec. 10, 2013 in PCT/JP13/05184 Filed Sep. 3, 2013.
(Continued)

*Primary Examiner* — Robert W Horn
(74) *Attorney, Agent, or Firm* — Oblon, McClelland, Maier & Neustadt, L.L.P.

(57) ABSTRACT

An elevator system is a one-shaft double-car elevator system and includes a floor-recognition abnormality detector to detect, with respect to one of the cars, a floor recognition abnormality that at least one of a car position and floor information cannot be normally recognized, a terminal-floor driving mechanism to make, on the basis of a notification of floor-recognition abnormality information detected by the floor-recognition abnormality detector, the other one of the cars travel to a terminal floor in a direction opposite to a direction toward the one of the cars, and a floor-recognition-abnormality correcting-operation mechanism to perform, on the basis of terminal-floor traveling information from the terminal-floor driving mechanism, a floor-recognition-abnormality correcting-operation to correct the floor recognition abnormality of the one of the cars; therefore, an operation to recover from the abnormality can be safely performed without collision of the cars.

7 Claims, 7 Drawing Sheets

(51) Int. Cl.
*B66B 1/06* (2006.01)
*B66B 3/02* (2006.01)

(56) References Cited

U.S. PATENT DOCUMENTS 6,978,863 B2 * 12/2005 Hikita ..... B66B 1/18 187/382
7,779,967 B2 * 8/2010 Kocher ..... B66B 5/0031 187/249
7,819,228 B2 * 10/2010 Terry ..... B66B 5/0031 187/249
7,980,362 B2 * 7/2011 Kostka ..... B66B 5/0031 187/249
8,020,668 B2 * 9/2011 Hsu ..... B66B 5/0031 187/247
8,356,697 B2 * 1/2013 Kriss ..... B66B 5/0031 187/249
8,424,651 B2 * 4/2013 Brand ..... B66B 1/2466 187/249
8,813,919 B2 * 8/2014 Silberhorn ..... B66B 5/0031 187/249
9,096,410 B2 * 8/2015 Iwata ..... B66B 5/0031
9,296,590 B2 * 3/2016 Kocher ..... B66B 1/30
9,394,139 B2 * 7/2016 Kugiya ..... B66B 1/32
2006/0289241 A1 12/2006 Okamoto et al.
2009/0223747 A1 9/2009 Hsu et al.
2011/0120809 A1 * 5/2011 Kocher ..... B66B 5/16 187/249
2013/0118837 A1 * 5/2013 Altenburger ..... B66B 5/0031 187/249
2014/0291077 A1 * 10/2014 Suzuki ..... B66B 1/2433 187/382
2015/0291390 A1 * 10/2015 Kakio ..... B66B 5/0031 187/249
2016/0039635 A1 * 2/2016 Kangas ..... B66B 1/48 187/277
2016/0122156 A1 * 5/2016 Kondo ..... B66B 5/0031 187/247
2016/0200548 A1 * 7/2016 Yamagishi ..... B66B 5/02 187/247

FOREIGN PATENT DOCUMENTS

JP 11-60091 A 3/1999
JP 2000-128453 A 5/2000
JP 2009-256109 A 11/2009
JP 2009-539726 A 11/2009
JP 2013-170080 A 9/2013
WO 2005/115900 A1 12/2005

OTHER PUBLICATIONS

Office Action issued Aug. 23, 2016 in Japanese Patent Application No. 2015-535175 (with English translation).

* cited by examiner

ELEVATOR SYSTEM

TECHNICAL FIELD

The present invention relates to a one-shaft double-car elevator system in which two elevator cars are provided in a single hoist way so as to travel independently, and that performs a return-to-normal operation in a case where the system cannot normally recognize at least one of the position and a floor with respect to a car being a control target.

BACKGROUND ART

As a conventional technique, a one-shaft multi-car configuration is disclosed (for example, in paragraph 0013 of Patent Document 1) in which only when one of cars normally stays at a floor, the other car is allowed to travel.

Furthermore, a one-shaft multi-car is disclosed (for example, Patent Document 2) in which floors are classified into accessible areas in operation.

PRIOR ART DOCUMENT

Patent Document

Patent Document 1: Japanese Patent Laid-Open Publication No. 2000-128453

Patent Document 2: Japanese Patent Laid-Open Publication No. 561-111284

SUMMARY OF THE INVENTION

Problem to be Solved by the Invention

Generally, an elevator car position is recognized with a counter value measured in advance or the like. For example, in a case where a sensor detects a floor landing, if a counter value indicates the same as that measured in advance or stays within a predetermined range, a car position is recognized to be correct. However, a temporary power outage, a surge, an elongation of rope, or the like sometimes causes a situation in which the counter value cannot be normally recognized. In that case, it becomes necessary to re-memorize the counter value. In Patent Documents 1 and 2, a case is not taken into account that it has become impossible to normally recognize a relation between positions of one of the cars and the other car, which results in a problem that how to restore to normal in such a case is unclear.

Means for Solving Problem

An elevator system according to the present invention that is a one-shaft double-car elevator system provided with two elevator cars in a single hoist way so as to travel independently, and that performs, on the basis of abnormality detection of one of the cars, travel control of the other one of the cars, and performs, on the basis of the travel control of the other one of the cars, travel control of the one of the cars, includes: a floor-recognition abnormality detection means to detect, with respect to the one of the cars, a floor recognition abnormality that at least one of a car position and floor information cannot be normally recognized; a terminal-floor driving means to make, on the basis of a notification of floor-recognition abnormality information detected by the floor-recognition abnormality detection means, the other one of the cars travel to a terminal floor in a direction opposite to a direction toward the one of the cars; and a floor-recognition-abnormality correcting-operation means to perform, on the basis of terminal-floor traveling information from the terminal-floor driving means, a floor-recognition-abnormality correcting-operation to correct the floor recognition abnormality of the one of the cars.

Effect of the Invention

In a one-shaft double-car elevator system according to the invention, when there arises an abnormality in that a car position cannot be normally recognized, an operation to recover from the abnormality can be safely performed without collision of the cars.

MODES FOR CARRYING OUT THE INVENTION

Embodiment 1

Figure 1:
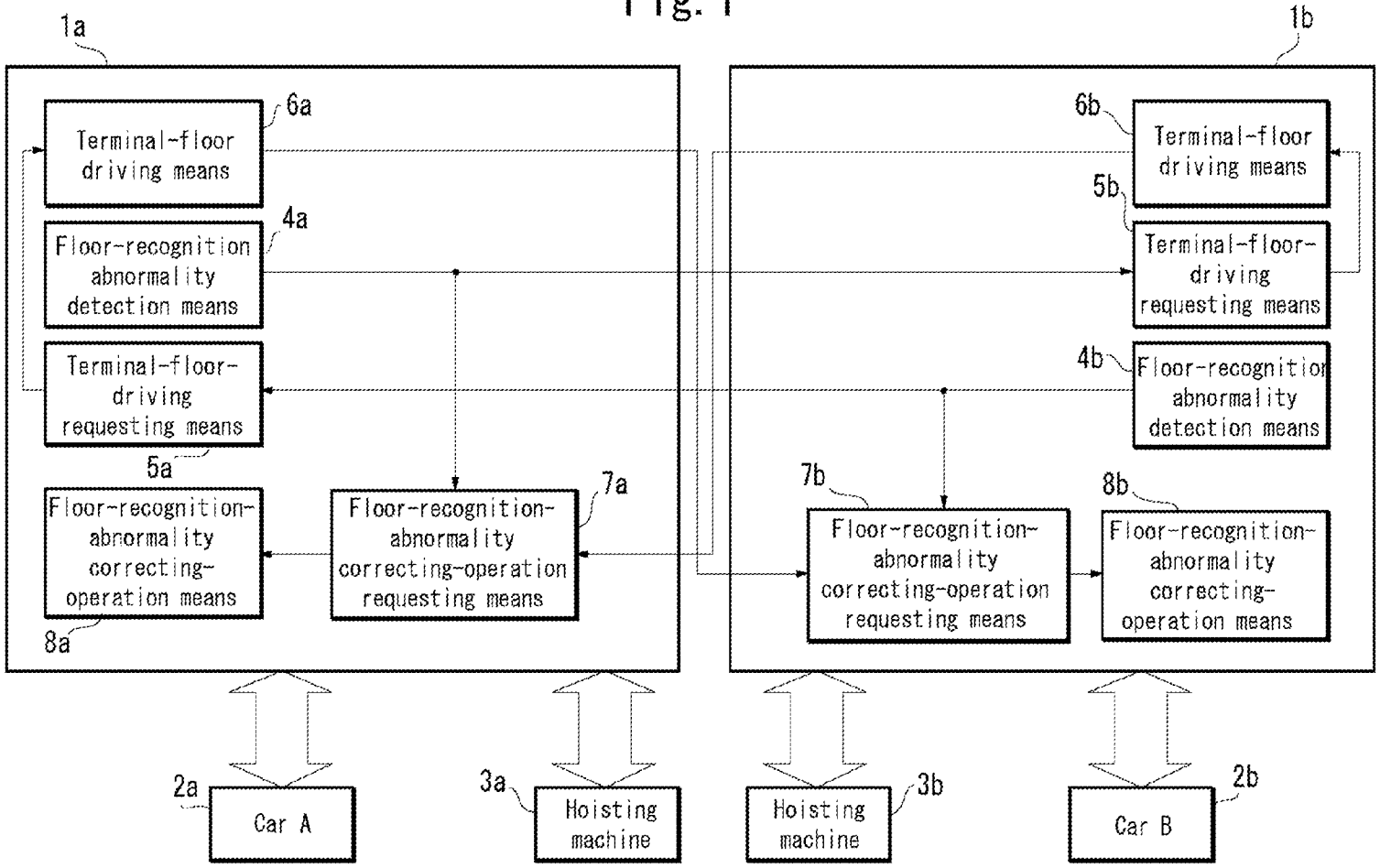
FIG. 1 is a configuration diagram showing elevator systems according to Embodiments 1 to 3 and 5 of the present invention.

FIG. 1 is a configuration diagram showing an elevator system in Embodiment 1 of the present invention. In FIG. 1, a car A (2*a*) being an upper car and a car B (2*b*) being a lower car are provided in a single hoist way (not shown in the figure) and are controlled by an upper-car elevator controller (1*a*) and a lower-car elevator controller (1*b*), respectively.

The upper-car elevator controller (1*a*) includes a floor-recognition abnormality detection means (4*a*) that detects a floor recognition abnormality that it becomes impossible to normally recognize at least one of car position information and floor information, a terminal-floor-driving requesting means (5*a*) that, in response to a notification of floor-recognition abnormality information received from the lower-car elevator controller (1*b*), makes a request to travel to a terminal floor in a direction where the lower car does not exist, a terminal-floor driving means (6*a*) that, according to the request from the terminal-floor-driving requesting means (5*a*), performs operations for traveling to and stopping at the terminal floor, a floor-recognition-abnormality correcting-operation requesting means (7*a*) that requests a floor-recognition-abnormality correcting-operation according to terminal-floor traveling information received from a terminal-floor driving means (6*b*), and a floor-recognition-abnormality correcting-operation means (8*a*) that performs the floor-recognition-abnormality correcting-operation according to the request from the floor-recognition-abnormality correcting-operation requesting means (7*a*).

Here, notification of the floor-recognition abnormality information is made in a case when, for example, comparison between prior obtained information (counter value) representing a floor and information (counter value) representing a normal floor landing position reveals a disagreement therebetween or a deviation over a predetermined range (if counter value, within ±10, for example).

In addition, notification of the terminal-floor traveling information is made when, for example, the car B has completed a travel to the terminal floor and then has stopped; however, the notification of the information may be made when the car B starts traveling to the terminal floor.

The car A (2*a*) being the upper car and a hoisting machine (3*a*) is connected to the upper-car elevator controller (1*a*).

The lower-car elevator controller (1*b*) includes a floor-recognition abnormality detection means (4*b*) that detects a floor recognition abnormality that it becomes impossible to normally recognize at least one of car position information and floor information, a terminal-floor-driving requesting means (5*b*) that, in response to a notification of floor-recognition abnormality information received from the upper-car elevator controller (1*a*), makes a request to travel to a terminal floor in a direction where the upper car does not exist, a terminal-floor driving means (6*b*) that, according to the request from the terminal-floor-driving requesting means (5*b*), performs operations for traveling to and stopping at the terminal floor, a floor-recognition-abnormality correcting-operation requesting means (7*b*) that requests a floor-recognition-abnormality correcting-operation according to the terminal-floor traveling information received from the terminal-floor driving means (6*a*), and a floor-recognition-abnormality correcting-operation means (8*b*) that performs the floor-recognition-abnormality correcting-operation according to the request from the floor-recognition-abnormality correcting-operation requesting means (7*b*).

Here, notification of the floor-recognition abnormality information is made in a case when, for example, comparison between prior obtained information (counter value) representing a floor and information (counter value) representing a normal floor landing position reveals a disagreement therebetween or a deviation over a predetermined range (if counter value, within ±10, for example).

In addition, notification of the terminal-floor traveling information is made when, for example, the car A has completed a travel to the terminal floor and then has stopped; however, the notification of the information may be made when the car A starts traveling to the terminal floor.

The car B (2*b*) being the lower car and a hoisting machine (3*b*) are connected to the lower-car elevator controller (1*b*).

Figure 2:
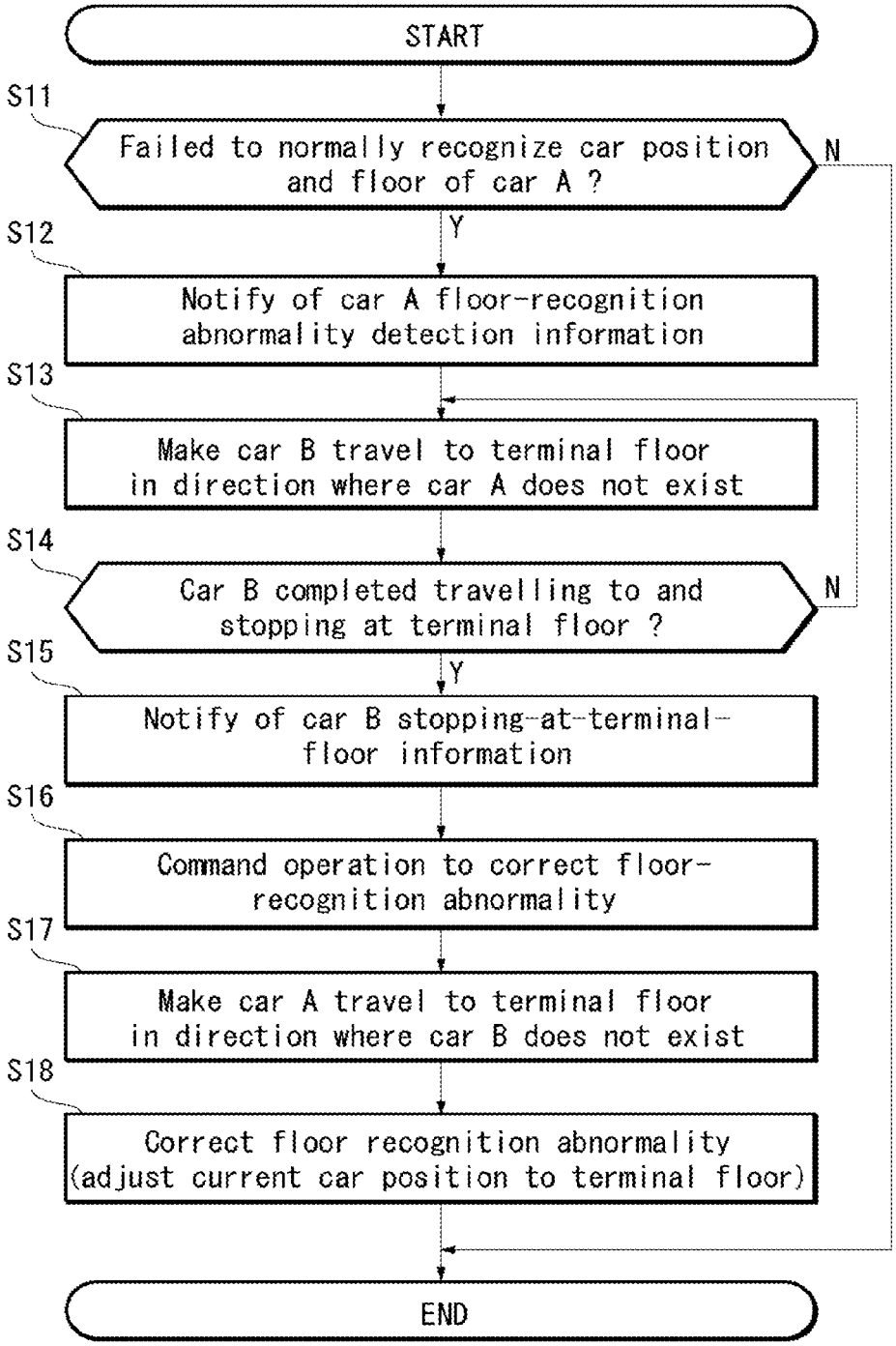
FIG. 2 is a flow chart explaining operations of the elevator system according to Embodiment 1 of the present invention.

Next, operations of FIG. 1 will be explained using FIG. 2. FIG. 2 is an operation flow chart in Embodiment 1 of the present invention.

First, at S11, the floor-recognition abnormality detection means (4*a*) determines whether it has become impossible to normally recognize at least one of car position of the car A (3*a*) and floor; if impossible to normally recognize, the process proceeds to S12; and if possible to normally recognize, the process ends.

At S12, the floor-recognition-abnormality correcting-operation requesting means (7*a*) and the terminal-floor-driving requesting means (5*b*) is notified of floor-recognition abnormality information about the car A detected by the floor-recognition abnormality detection means (4*a*), and then the process proceeds to S13.

At S13, on the basis of the terminal-floor traveling request information from the terminal-floor-driving requesting means (5*b*), the terminal-floor driving means (6*b*) makes the car B (2*b*) being the lower car, travel to a terminal floor in a direction where the car A (2*a*) being the upper car does not exist; then, the process proceeds to S14.

At S14, by notification of the terminal-floor traveling information made by the terminal-floor driving means (6*b*), it is determined whether or not the car B (2*b*) being the lower car has completed travelling to the terminal floor and stopping. If not completed, the process returns to S13 (S14; NO); if completed, the process proceeds to S15 (S14; YES). In addition, here, the notification may be made when the car B begins travelling to the terminal floor.

At S15, the terminal-floor driving means (6*b*) notifies the floor-recognition-abnormality correcting-operation requesting means (7*a*) of traveling-to-and-stopping-at-terminal-floor information about the car B; then, the process proceeds to S16.

At S16, on the basis of the floor recognition abnormality detection information from the floor-recognition abnormality detection means (4*a*) and the traveling-to-and-stopping-at-terminal-floor information about the car B from the terminal-floor driving means (6*b*), the floor-recognition-abnormality correcting-operation requesting means (7*a*) commands a request for an operation to correct the floor-recognition abnormality to the floor-recognition-abnormality correcting-operation means (8*a*); then, the process proceeds to S17.

At S17, the floor-recognition-abnormality correcting-operation means (8*a*) makes the car A (2*a*) being the upper car, travel to a terminal floor in a direction where the car B (2*b*) being the lower car does not exist; then, the process proceeds to S18.

At S18, because the car A (2*a*) being the upper car is at the terminal floor, the floor recognition abnormality is corrected by correcting the current car position to the position of the terminal floor on the basis of information of, for example, a floor recognition device (not shown in figures) indicating the terminal floor and a floor landing device (not shown in figures) indicating a normal floor landing position.

In addition, the elevator system may not be provided with the floor-recognition abnormality detection means (4*b*), the terminal-floor-driving requesting means (5*a*), the terminal-floor driving means (6*a*), the floor-recognition-abnormality correcting-operation requesting means (7*b*), and the floor-recognition-abnormality correcting-operation means (8*b*) that are shown in FIG. 1 but have not been used for the explanation of Embodiment 1.

According to the one-shaft double-car elevator system of Embodiment 1, in a case where there arises an abnormality in that a car position cannot be normally recognized, an operation to recover from the abnormality can be safely performed without collision of the cars.

Embodiment 2

In Embodiment 1, explanation has been made about a case where a floor landing recognition abnormality has been detected in the car A being the upper car; however, explanation will be made about a case where a floor landing recognition abnormality is detected in the car B being the lower car.

FIG. 1 is a configuration diagram showing an elevator system according to Embodiment 2. All configurational explanation has been made in Embodiment 1, therefore the configurational explanation will be omitted.

Figure 3:
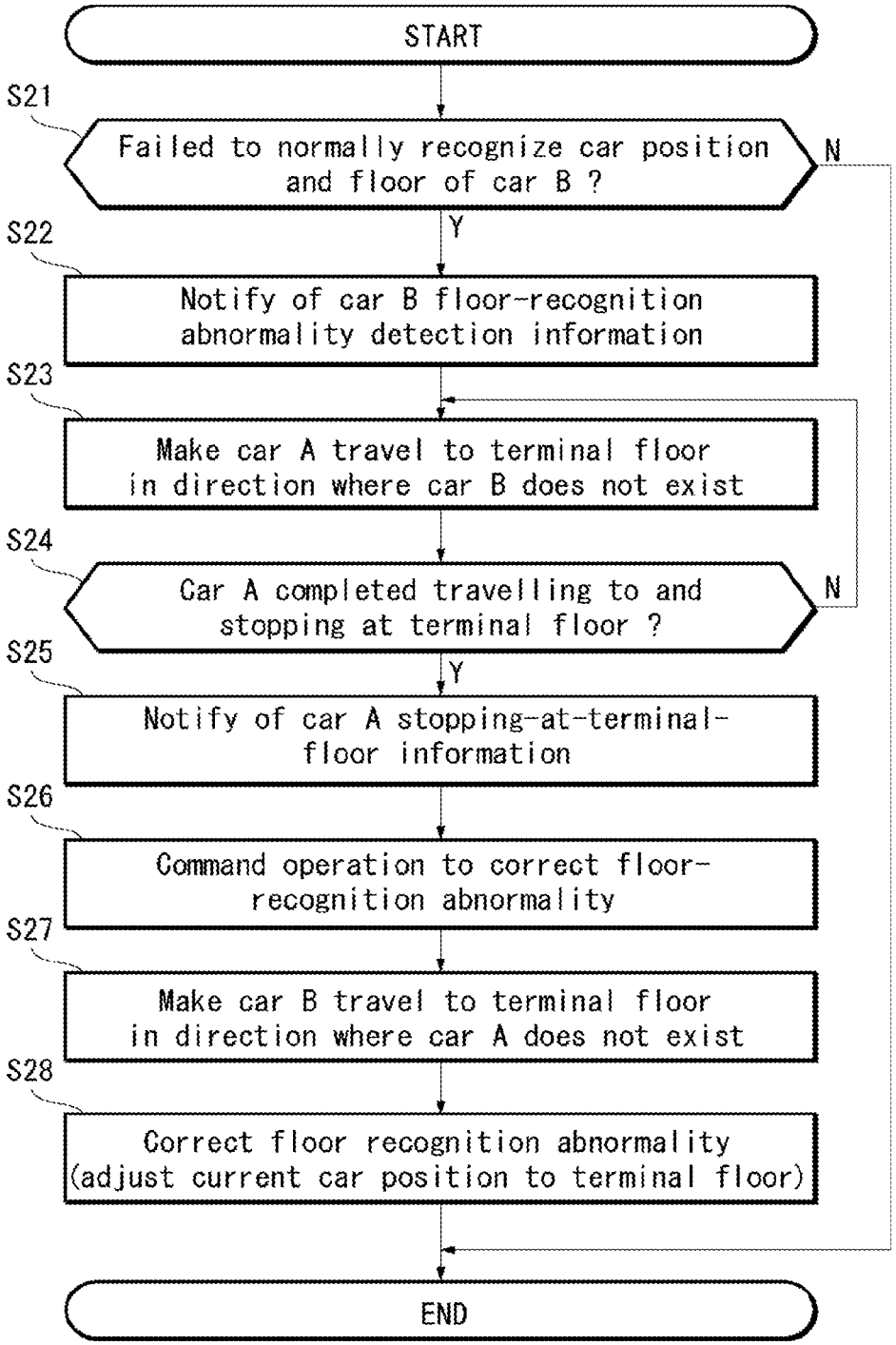
FIG. 3 is a flow chart explaining operations of the elevator system according to Embodiment 2 of the present invention.

Next, operations in FIG. 1 will be explained using FIG. 3. FIG. 3 is an operation flow chart in Embodiment 2 of the present invention.

First, at S21, the floor-recognition abnormality detection means (4*b*) determines whether it has become impossible to normally recognize at least one of car position of the car B (3*b*) and floor; if impossible to normally recognize, the process proceeds to S22; and if possible to normally recognize, the process ends.

At S22, the floor-recognition-abnormality correcting-operation requesting means (7*b*) and the terminal-floor-driving requesting means (5*a*) are notified of floor-recognition abnormality information about the car B detected by the floor-recognition abnormality detection means (4*b*), and then the process proceeds to S23.

At S23, on the basis of the terminal-floor traveling request information from the terminal-floor-driving requesting means (5*a*), the terminal-floor driving means (6*a*) makes the car A (2*a*) being the upper car, travel to a terminal floor in a direction where the car B (2*b*) being the lower car does not exist; then, the process proceeds to S24.

At S24, by notification of the terminal-floor traveling information made by the terminal-floor driving means (6*a*), it is determined whether or not the car A (2*a*) being the upper car completes travelling to the terminal floor and stopping. If not completing, the process returns to S23 (S24; NO); if completing, the process processed to S25 (S24; YES). In addition, here, the notification may be made when the car A begins travelling to the terminal floor.

At S25, the terminal-floor driving means (6*a*) notifies the floor-recognition-abnormality correcting-operation requesting means (7*b*) of traveling-to-and-stopping-at-terminal-floor information about the car A; then, the process proceeds to S26.

At S26, on the basis of the floor recognition abnormality detection information from the floor-recognition abnormality detection means (4*b*) and the traveling-to-and-stopping-at-terminal-floor information about the car A from the terminal-floor driving means (6*a*), the floor-recognition-abnormality correcting-operation requesting means (7*b*) commands an operation to correct the floor-recognition abnormality to the floor-recognition-abnormality correcting-operation means (8*b*); then, the process proceeds to S27.

At S27, the floor-recognition-abnormality correcting-operation means (8*b*) makes the car B (2*b*) being the lower car, travel to a terminal floor in a direction where the car A (2*a*) being the upper car does not exist; then, the process proceeds to S28.

At S28, because the car B (2*b*) being the lower car is at the terminal floor, the floor recognition abnormality is corrected by rememorizing the terminal floor information (counter value) memorized in advance as the current car position information (counter value).

In addition, the elevator system may not be provided with the floor-recognition abnormality detection means (4*a*), the terminal-floor-driving requesting means (5*b*), the terminal-floor driving means (6*b*), the floor-recognition-abnormality correcting-operation requesting means (7*a*), and the floor-recognition-abnormality correcting-operation means (8*a*) that are shown in FIG. 1 but have not been used for the explanation of Embodiment 2.

According to the one-shaft double-car elevator system of Embodiment 2, similarly to Embodiment 1, in a case where there arises an abnormality in that a car position cannot be normally recognized, an operation to recover from the abnormality can be safely performed without collision of the cars.

Embodiment 3

In Embodiments 1 to 2, a floor landing recognition abnormality is detected in the car A being the upper car or in the car B being the lower car; however, in this embodiment, an example will be explained in which a floor landing recognition abnormality is detected with one of elevator cars being referred to as "one of the cars" and with the other elevator car being referred to as "the other car".

Figure 4:
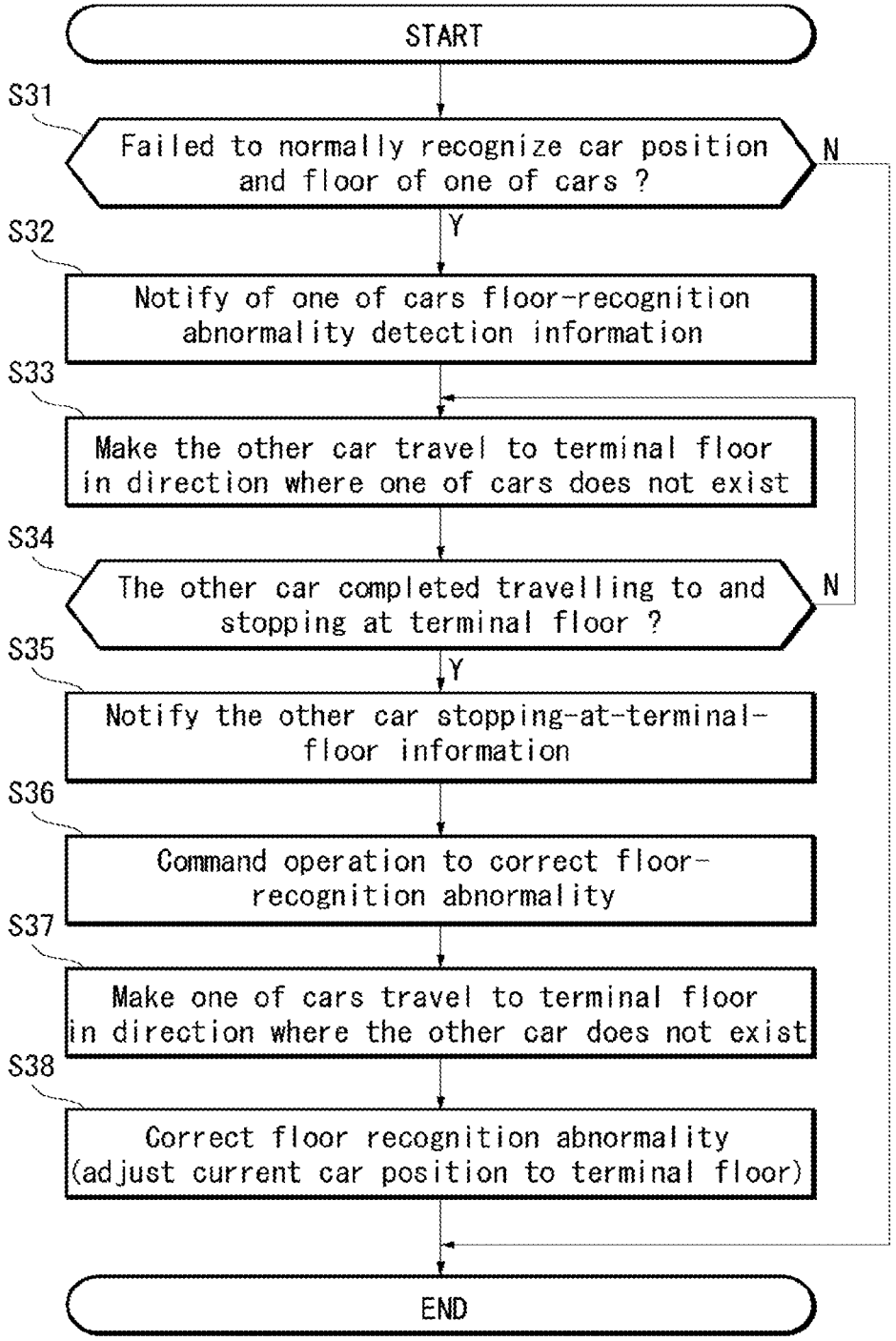
FIG. 4 is a flow chart explaining operations of the elevator system according to Embodiment 3 of the present invention.

FIG. 1 is a configuration diagram showing an elevator system according to Embodiment 3, and FIG. 4 is an operational flow chart in Embodiment 3 of the present invention.

If in the description and figures of Embodiment 1, the wordings of the upper car and the lower car are changed to the one of cars and the other car, respectively, all explanations of this embodiment have been made in Embodiment 1. Therefore, explanations of the configuration and operation will be omitted.

According to the one-shaft double-car elevator system of Embodiment 3, in a case where there arises an abnormality in that a car position cannot be normally recognized, an operation to recover from the abnormality can be safely performed similarly to Embodiments 1 and 2 without collision of the cars.

Embodiment 4

In Embodiments 1 to 3, it is assumed that no passenger is on board the other car where a floor recognition abnormality is detected; however, the present invention can also be applied when a passenger is on board the other car.

Figure 5:
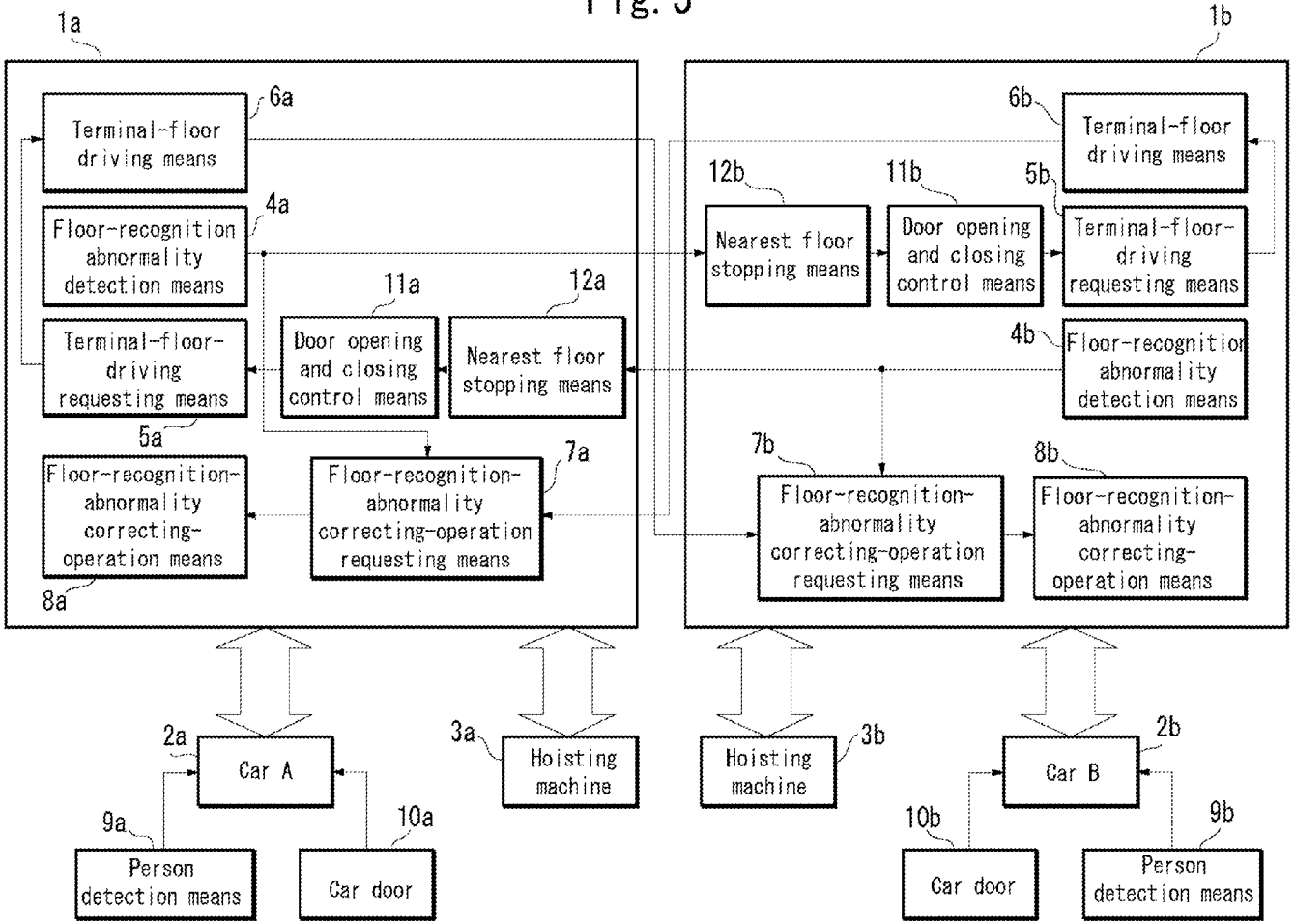
FIG. 5 is a configuration diagram showing an elevator system according to Embodiment 4 of the present invention.

FIG. 5 is a configuration diagram of an elevator system according to Embodiment 4. In the diagram, because components designated as the same symbols as those in FIG. 1 have already been explained in FIG. 1, explanation of the components will be omitted.

In FIG. 5, a person detection means (9*a*) which is provided in the car A (2*a*) being the upper car to detect the presence or absence of a passenger, and a car door (10*a*) are connected to the car. There are further provided a nearest floor stopping means (12*a*) that performs an operation for stopping at a nearest floor due to floor recognition abnormality detection information from the floor-recognition abnormality detection means (4*b*) of the lower-car elevator controller (1*b*), and a door opening and closing control means (11*a*).

Moreover, a person detection means (9*b*) which is provided in the car B (2*b*) being the lower car to detect the presence or absence of a passenger, and a car door (10*b*) are connected to the car. There are further provided a nearest floor stopping means (12*b*) that performs an operation for stopping at a nearest floor due to floor recognition abnormality detection information from the floor-recognition abnormality detection means (4*a*) of the upper-car elevator controller (1*a*), and a door opening and closing control means (11*b*).

Figure 6:
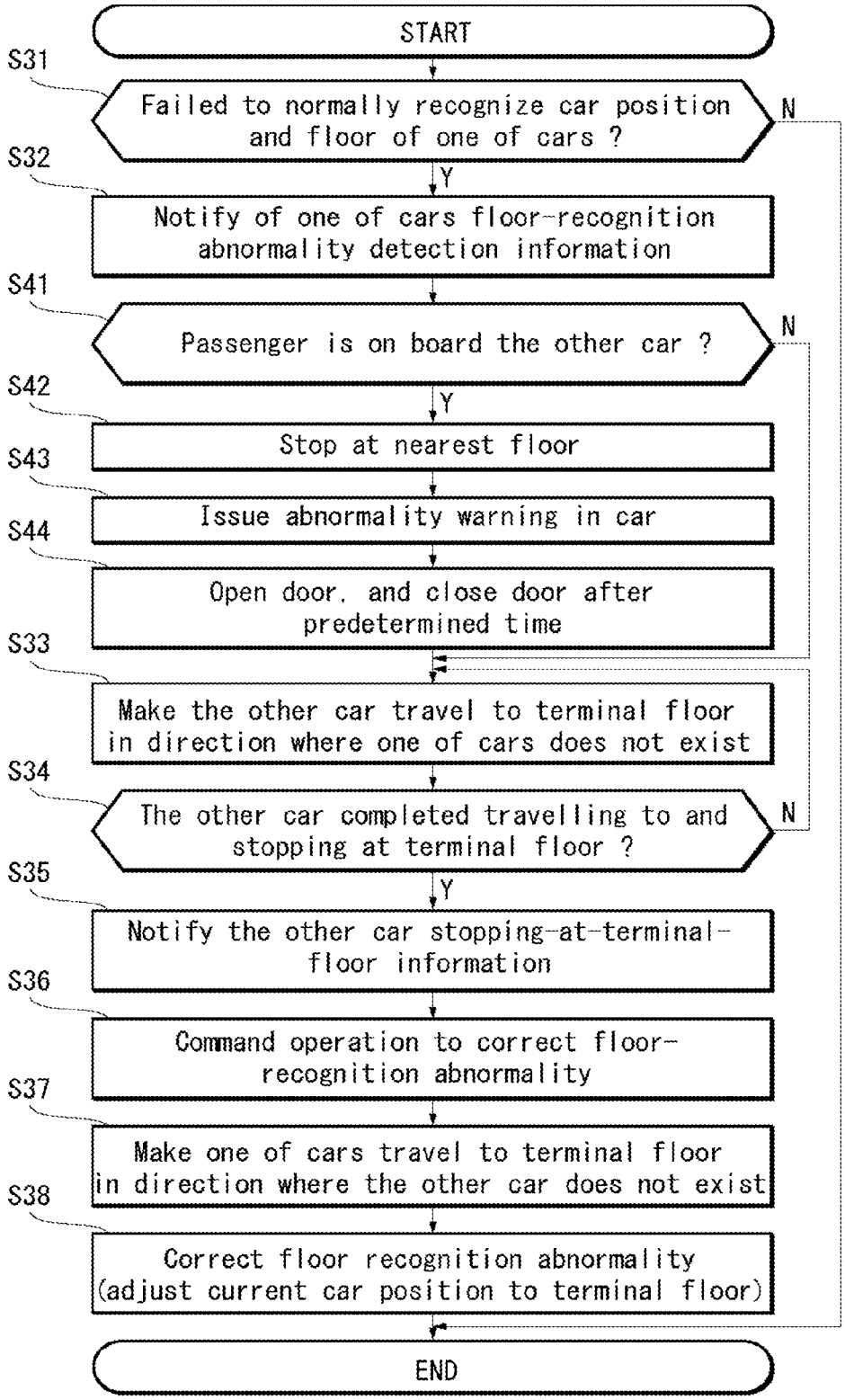
FIG. 6 is a flow chart explaining operations of the elevator system according to Embodiment 4 of the present invention.

Next, operations in FIG. 5 will be explained on the basis of FIG. 6. FIG. 6 is an operational flow chart in Embodiment 4 of the present invention.

First, at S31, the floor-recognition abnormality detection means (4*a*) determines whether it has become impossible to normally recognize at least one of car position of one of the cars (2*a*) and floor; if impossible to normally recognize, the process proceeds to S32; and if possible to normally recognize, the process ends.

At S32, the floor-recognition-abnormality correcting-operation requesting means (7*a*) and the terminal-floor-driving requesting means (5*b*) are notified of the floor-recognition abnormality information about the one of the cars detected by the floor-recognition abnormality detection means (4*a*), and then the process proceeds to S41.

At S41, the person detection means (9*b*) of the other car determines whether or not a passenger is on board the other car (2*b*); if on board, the process proceeds to S42 (S41; YES); if not on board, the process proceeds to S33 (S41; NO).

At S42, because a passenger is on board the other car (2*b*), the nearest floor stopping means (12*b*) performs an operation for stopping at a nearest floor, and then the process proceeds to S43.

At S43, a warning signifying an abnormality is issued in the other car (2*b*). For example, "An abnormality occurs. Please get out" or the like is displayed on an in-car display device not shown in the figure, or a voice notification of the same meaning is made. Either or both of the display and the notification may be performed. After the display or the notification, the process proceeds to S44.

At S44, the door opening and closing control means (11*b*) opens the door for a period, for example four seconds, sufficient for the passenger to get out of the car, and then closes the door, so that the process proceeds to S33. Operations after S33 have already been explained in Embodiment 3, therefore the explanation thereof will be omitted.

In the elevator system of Embodiment 4, when a floor recognition abnormality is detected in one of the cars, the other car is made to travel to the terminal floor after a passenger in the other car is made to get out; therefore, in addition to effects of Embodiments 1 to 3, the elevator system has an effect that in a case where a passenger is on board the other car, the elevator system can prevent the passenger from being kept trapped for a while.

Embodiment 5

In Embodiments 1 to 4, it is assumed that a floor recognition abnormality is detected only in either one of the cars; however, the present invention can also cope with a case where abnormalities occur in both cars.

FIG. 1 is a configuration diagram of an elevator system according to Embodiment 5. All components have been explained in Embodiment 1, therefore, explanation thereof will be omitted.

Figure 7:
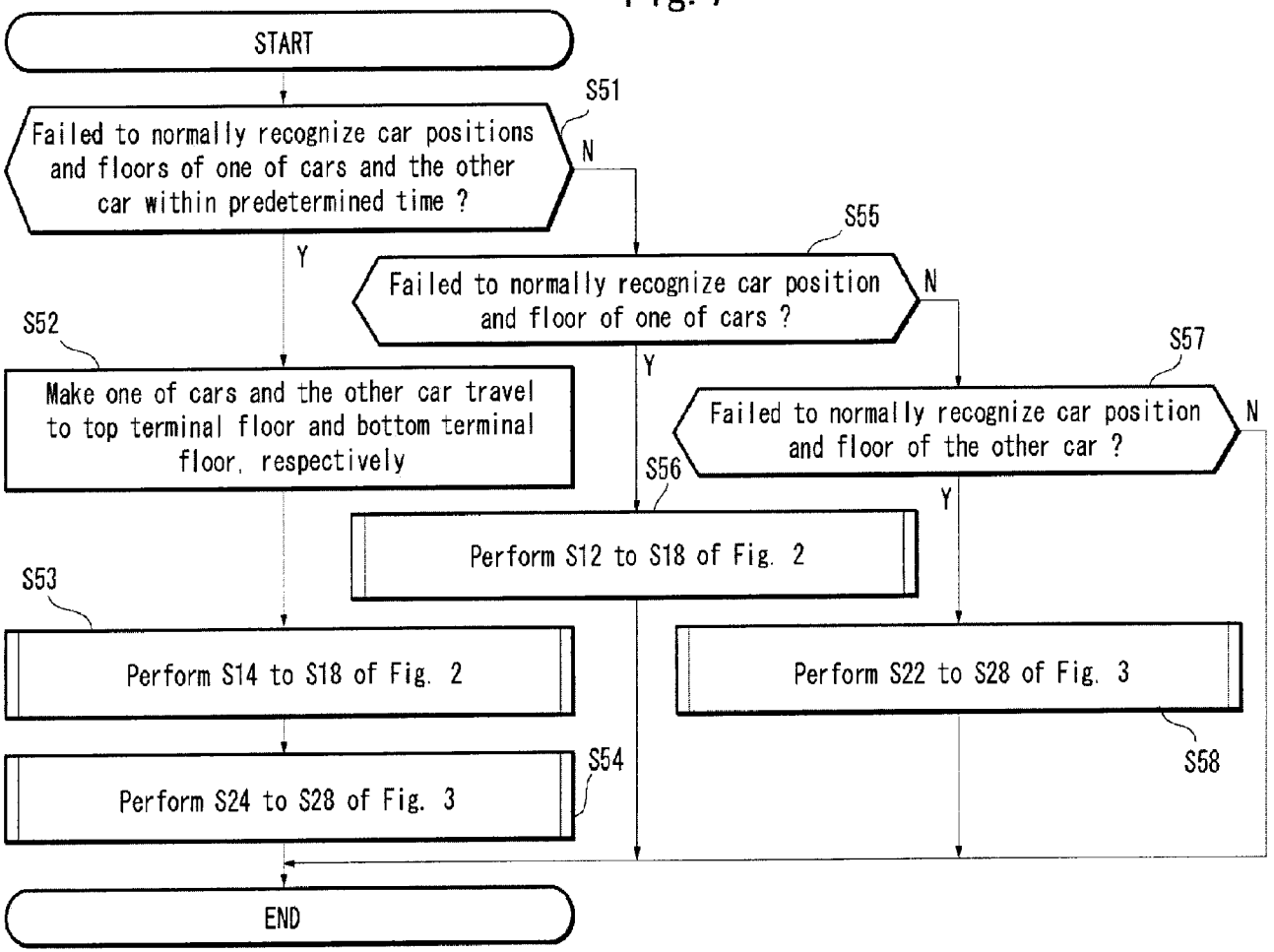
FIG. 7 is a flow chart explaining operations of the elevator system according to Embodiment 5 of the present invention.

Next, operations of FIG. 1 will be explained on the basis of FIG. 7. FIG. 7 is an operational flow chart in Embodiment 5 of the present invention.

Firstly, at S51, for both of the one of the cars (2*a*) and the other car (2*b*), the floor-recognition abnormality detection means (4*a*, 4*b*) determine, for example in ten seconds, whether it has become impossible to normally recognize at least one of car position and floor; if neither means can normally recognize, the process proceeds to S52 (S51; YES); if at least one of the means can normally recognize, the process proceeds to S55 (S51; NO).

At S52, the one of the cars is made to travel to the top terminal floor and the other car is made to travel to the bottom terminal floor by the terminal-floor-driving requesting means (5*b*,5*a*) and the terminal-floor driving means (6*b*,6*a*); then, the process proceeds to S53.

At S53, the operations of S14 to S18 of FIG. 2 explained in Embodiment 1 are performed; then, the process proceeds to S54.

At S54, the operations of S24 to S28 of FIG. 3 explained in Embodiment 2 are performed; then, the process ends.

At S55, the floor-recognition abnormality detection means (4*a*) determines whether it has become impossible to normally recognize at least one of the car position and the floor in the one of the cars (2*a*); if impossible to normally recognize, the process proceeds to S56 (S55; YES); if possible to normally recognize, the process proceeds to S57 (S55; NO).

At S56, operations of S12 to S18 of FIG. 2 explained in Embodiment 1 are performed; then, the process ends.

At S57, the floor-recognition abnormality detection means (4*b*) determines whether it has become impossible to normally recognize at least one of the car position and the floor in the other car (2*b*); if impossible to normally recognize, the process proceeds to S58 (S57; YES); if possible to normally recognize, the process ends (S57; NO).

At S58, operations of S22 to S28 of FIG. 3 explained in Embodiment 2 are performed; then, the process ends.

According to the elevator system of Embodiment 5, even in a case where a floor recognition abnormality is detected in both of the cars, an operation to recover from the abnormality can be safely performed without collision of the cars.

Although explanation has been made while "one of the cars" and "the other car" are referred to as "upper car" and "lower car" for convenience, "one of the cars" and "the other car" may be referred to as "lower car" and "upper car", which also brings the same effect as that of the above-described embodiments.

Furthermore, the above embodiments may be suitably combined, which brings their respective effects.

INDUSTRIAL APPLICABILITY

The present invention can be applied to an elevator information system in which elevator information displayed in an elevator car is updated through wireless communication.

NUMERAL EXPLANATION

1*a* upper-car elevator controller
1*b* lower-car elevator controller
2*a* upper car
2*b* lower car
3*a* upper-car hoisting machine
3*b* lower-car hoisting machine
4*a* upper-car floor-recognition abnormality detection means
4*b* lower-car floor-recognition abnormality detection means
5*a* driving-upper-car-to-terminal-floor requesting means
5*b* driving-lower-car-to-terminal-floor requesting means
6*a* upper-car terminal-floor driving means
6*b* lower-car terminal-floor driving means
7*a* upper-car floor-recognition-abnormality correcting-operation requesting means
7*b* lower-car floor-recognition-abnormality correcting-operation requesting means
8*a* upper-car floor-recognition-abnormality correcting-operation means
8*b* lower-car floor-recognition-abnormality correcting-operation means
9*a* upper-car person detection means
9*b* lower-car person detection means
10*a* upper-car door
10*b* lower-car door

The invention claimed is:

1. An elevator system that is a one-shaft double-car elevator system provided with two elevator cars in a single hoist way so as to travel independently, and that performs, on the basis of abnormality detection of one of the cars, travel control of the other one of the cars, and performs, on the basis of the travel control of the other one of the cars, travel control of the one of the cars, comprising:

a first floor-recognition abnormality detector to detect, with respect to the one of the cars, a floor recognition abnormality that at least one of a car position and floor information cannot be normally recognized;

a first terminal-floor driver to make, on the basis of a notification of floor-recognition abnormality information detected by the first floor-recognition abnormality detector, the other one of the cars travel to a terminal floor in a direction opposite to a direction toward the one of the cars; and a first floor-recognition-abnormality correcting-operation unit to perform, on the basis of terminal-floor traveling information from the first terminal-floor driver, a floor-recognition-abnormality correcting-operation to correct the floor recognition abnormality of the one of the cars.

2. The elevator system according to claim 1, further comprising:

a second floor-recognition abnormality detector to detect, with respect to the other one of the cars, a floor recognition abnormality that at least one of a car position and floor information cannot be normally recognized;

a second terminal-floor driver to make, on the basis of a notification of floor-recognition abnormality information detected by the second floor-recognition abnormality detector, the one of the cars travel to a terminal floor in a direction opposite to a direction toward the other one of the cars; and a second floor-recognition-abnormality correcting-operation unit to perform, on the basis of terminal-floor traveling information from the second terminal-floor driver, a floor-recognition-abnormality correcting operation to correct the floor recognition abnormality of the other one of the cars.

3. The elevator system according to claim 1, further comprising:

a person detector to detect, when the first floor-recognition abnormality detector detects a floor recognition abnormality, whether or not a passenger is on board the other one of the cars;

a nearest floor stopper to control to stop at a nearest floor when the person detector detects a passenger; and a door opening and closing controller to open a door, and close the door after a predetermined time.

4. The elevator system according to claim 2, further comprising:

a person detector to detect, when the first floor-recognition abnormality detector detects a floor recognition abnormality, whether or not a passenger is on board the other one of the cars;

a nearest floor stopper to control to stop at a nearest floor when the person detector detects a passenger; and a door opening and closing controller to open a door, and close the door after a predetermined time.

5. The elevator system according to claim 2, wherein when each of the first floor-recognition abnormality detector and the second floor-recognition abnormality detector detects a floor recognition abnormality within a predetermined time, the first terminal floor driver makes the other one of the cars travel to a terminal floor in a direction opposite to a direction toward the one of the cars, and the second terminal floor driver makes the one of the cars travel to a terminal floor in a direction opposite to a direction toward the other one of the cars.

6. The elevator system according to claim 3, wherein when each of the first floor-recognition abnormality detector and the second floor-recognition abnormality detector detects a floor recognition abnormality within a predetermined time, the first terminal-floor driver makes the other one of the cars travel to a terminal floor in a direction opposite to a direction toward the one of the cars, and the second terminal-floor driver makes the one of the cars travel to a terminal floor in a direction opposite to a direction toward the other one of the cars.

7. The elevator system according to claim 4, wherein when each of the first floor-recognition abnormality detector and the second floor-recognition abnormality detector detects a floor recognition abnormality within a predetermined time, the first terminal-floor driver makes the other one of the cars travel to a terminal floor in a direction opposite to a direction toward the one of the cars, and the second terminal-floor driver makes the one of the cars travel to a terminal floor in a direction opposite to a direction toward the other one of the cars.

* * * * *